US006995660B2

(12) United States Patent
Yannone et al.

(10) Patent No.: US 6,995,660 B2
(45) Date of Patent: Feb. 7, 2006

(54) COMMANDER'S DECISION AID FOR COMBAT GROUND VEHICLE INTEGRATED DEFENSIVE AID SUITES

(75) Inventors: Ronald M. Yannone, Nashua, NH (US); Howard B. Partin, Hollis, NH (US)

(73) Assignee: Bae Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/337,671

(22) Filed: Jan. 6, 2003

(65) Prior Publication Data

US 2004/0061595 A1 Apr. 1, 2004

Related U.S. Application Data

(60) Provisional application No. 60/413,793, filed on Sep. 26, 2002.

(51) Int. Cl.
*B60Q 1/00* (2006.01)

(52) U.S. Cl. ..... 340/425.5; 340/426.14; 340/426.15; 340/426.16; 340/426.25; 342/14; 342/16; 342/18; 342/45

(58) Field of Classification Search ..... 340/425.5, 340/426.14, 426.16, 426.24, 426.25; 342/14, 342/16, 18, 45
See application file for complete search history.

(56) References Cited

U.S. PATENT DOCUMENTS 4,614,317 A * 9/1986 Stavis ..... 244/3.19
6,155,155 A * 12/2000 Moshier ..... 89/1.13
6,494,159 B2 * 12/2002 Sirmalis et al. ..... 114/312
6,549,872 B2 * 4/2003 Bollweg et al. ..... 702/158

* cited by examiner

*Primary Examiner*—Tai T. Nguyen
(74) *Attorney, Agent, or Firm*—Daniel J. Long

(57) ABSTRACT

A decision aid for use in the defense of a combat ground vehicle which includes a track fusion element, a threat typing element, threat prioritization element, and a countermeasures (CM) selection element.

14 Claims, 2 Drawing Sheets

COMMANDER'S DECISION AID FOR COMBAT GROUND VEHICLE INTEGRATED DEFENSIVE AID SUITES

CROSS REFERENCE TO RELATED APPLICATION

This application claims rights under Provisional U.S. Application Ser. No. 60/413,793 filed Sep. 26, 2002.

STATEMENT OF GOVERNMENT INTEREST

The Government of the United States may have rights in this application as a result of work done on the invention described herein under one or more of the following contract numbers with the Department of the Army: DAAE07-95-C-R043, DAAE07-97-C-X073, DAAE07-97-C-X100, DAAE30-95-C-0009, and DAAE07-02-C-L012.

BACKGROUND OF THE INVENTION

1. Field of the Invention

The present invention relates to countermeasures (CM) and more particularly to decision making with respect to CM.

2. Brief Description of Prior Developments

Ground combat vehicles such as tanks, howitzers and other artillery and reconnaissance vehicle typically have a proliferation of highly lethal, multispectral guidance approaches that may easily overwhelm the vehicle's capability to withstand hits from extremely lethal rounds such as the laser-designated guided Hellfire ATGM anti-tank guided missile. The critical need for rapid, accurate threat detection, identification, range estimates for TTG (time-to-go) estimation and applicable/timely countermeasure deployment for threat prioritization, avoidance. Targeting in this environment also requires total incorporation of the onboard and offboard resources in a reliable manner that interacts well with the vehicle commander. A need exists for a means to meet these advanced threats.

SUMMARY OF INVENTION

This invention assesses applicable threats, their behavior, guidance systems (laser semi-active homing, optical, laser beam rider, MMW (millimeter wave), kinetically shot, and the like), sensors required to detect these threats (both presently available and advanced technology required), and applicable countermeasure suite options, while taking into account battlefield clutter and the false target environment. The present invention includes a closed-loop architecture may be advantageously used that performs multisensor (multispectral) fusion, aggregate threat typing, lethality assessment, TTG (time-to-go) assessment, threat prioritization, sensor control, CM (countermeasures) selection, and CM effectiveness evaluation.

DETAILED DESCRIPTION OF THE DRAWINGS

Figure 1:
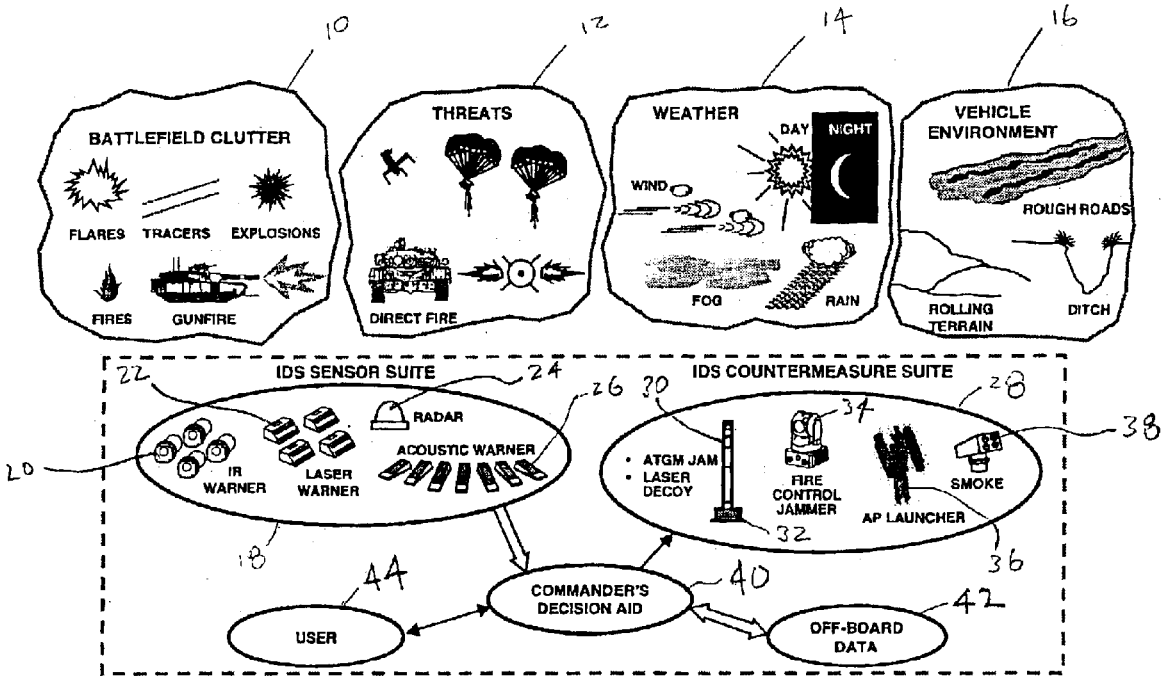
Figure 2:
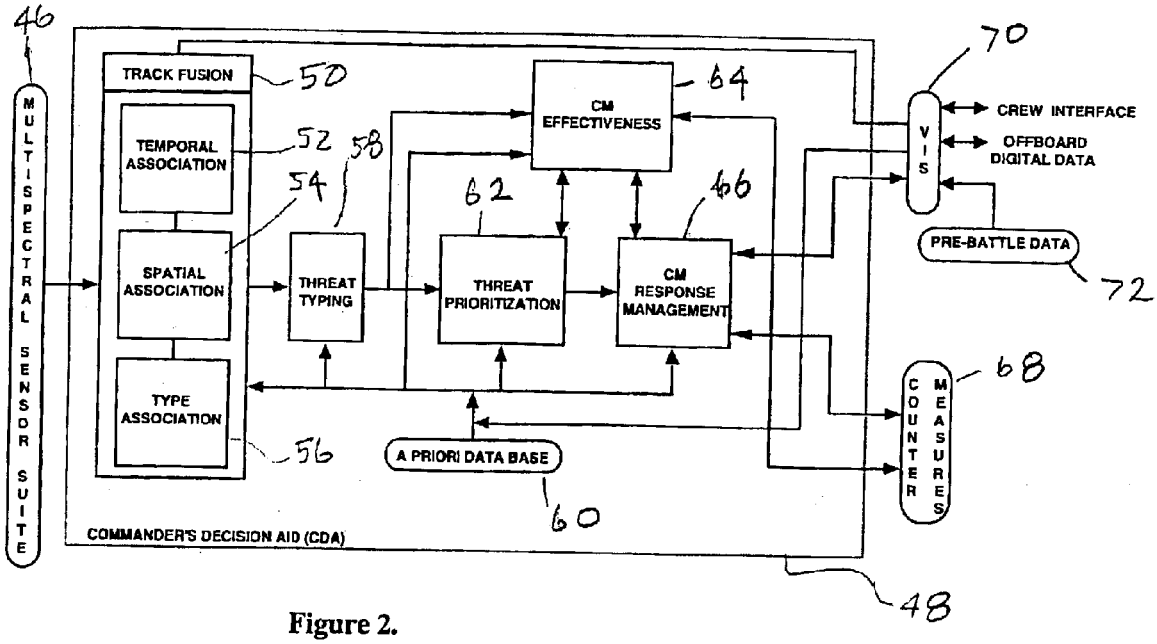

The present invention is further described with reference to the accompanying drawings wherein:

FIG. 1 is a schematic drawing showing the CDA problem space and a preferred embodiment of the IDS sensor suite and IDS countermeasure suite of the present invention; and FIG. 2 is a schematic drawing showing the CDA's architecture.

DETAILED DESCRIPTION OF THE PREFERRED EMBODIMENT

Referring to FIG. 1, the CDA problem space includes battlefield clutter 10 such as flares, tracers, explosions, fires and gunfire. It also includes threats 12, weather 14 including wind, fog, rain and day or night, and vehicle environment 16 such as rough roads, ditches and rolling terrain. The integrated defense system (IDS) sensor suite 18 includes an infrared warner 20, a laser warner 22, radar 26 and an acoustic warner 26. The IDS countermeasures suite 28 includes an ATGM jammer 30, a laser decoy 32, a fire control jammer 34, an AP launcher 36 and a smoke generator 38. The commander's decision aid (CDA) 40 receives and gives information to and from off-board data base 42 and provides information to the user 44. The infrared warner 20 detects missile launches, ground fire, explosive events from top attack (overhead) where there is least armor on top of the vehicle from howitzer-fired munitions and/or out of fighter or attack aircraft. The infrared warner 20 also looks for relevant explosive events within an angle around the initial infrared warner report. The laser warner 24 detects laser, semi-active homing (LSAH) missiles such as the U.S. Hellfire missile. The acoustic warner 26 allows for detection of tracked vehicles that are moving or idling as well as rotary winged vehicles. The radar warner 24 is active system/tucked away based on a warning sensor report (IRW, LWR, acoustic warning reports from a fellow tanker or from downlinks from satellite or UAV reports).

Referring to FIG. 2, the CDA's architecture is shown wherein a multispectral sensor suite 46 as described above provides a signal to the CDA 48 and in particular to track fusion element 50 which includes, temporal association 52, spatial association 54, and type association 56, which provides information to threat typing 58. An a priori data base 60 also provides information along with threat typing to threat prioritization 62 and to CM effectiveness 64 and to CM response management 66 and to countermeasures 68. There is also a visual display 70 which receives pre-battle data 72 and provides and receives information through crew interface and offboard digital data.

It will be appreciated that an analysis of the threats and their operational characteristics, battlefield events and their signatures, background clutter, sensors and sensor processing, CM options (and required advancements), the "integrated EW" concept, and vehicle dynamics, the five integral parts of the integrated algorithm (fusion, threat typing, threat prioritization, CM selection, CM effectiveness) were tailored to the ground combat vehicle problem space. These functions are further described in Table 1. Advantages of this system include: (1) easy use of offboard, a priori, and pre-mission data; (2) developing sensor correlation that incorporates the "sensed event" with the "threat launch" to determine if they are compatible, as, for example, a laser rangefinder detection with a missile warning report or a laser rangefinder report, missile launch report with a follow-on (several seconds later) laser semi-active homing designator report, (3) utilizing the Dempster-Shafer algorithm to merge threat type (e.g., class, ID) information and handle conflicting data, (4) computing threat lethality based on threat type and the approach angle toward the vehicle and relative armor strength, (5) computing an estimate of TTG (time-to-go) for the weapon to hit the vehicle, (6) performing resource/response management in such a way to either prevent unnecessary use of CMs, or to maximize the use of the timing and CM to handle more than one threat (salvo engagements) with one CM, and (7) perform CM effectiveness through the effective use and interpretation of the sensor information.

In addition to the above features, the system of this invention also provides: (1) an assessment of YATO/YANTO ("you-are-the-one"/"you-are-not-the-one") for inbound ATGMs (anti-tank guided missiles) as to whether the round is aimed at the vehicle to be or another friendly vehicle by use of P3I sensor developed PBO (post-burnout)

IR tracking capability and to use this for CM effectiveness as well after a CM has been applied; (2) use of Cauchy weighting functions to assign a probabilistic value to both spatially-and temporally-correlated battlefield events such as tying the laser rangefinder events to a missile launch and/or designator event by understanding the operational threat characteristics, or as a further example correlating the top-attack (SADARM [sense-and destroy armor] and SFW [sensor-fused weapon]) events to knowing the presence and timing of incoming "overhead" threat munitions; (2) performing passive ranging using the acoustic sensor angle measurements from two friendly vehicles to form a "combined threat ID" and range using the data link. The acoustic sensor provides passive detection of both rotary-winged aircraft (like helicopters) and surface tracked vehicles (as long as they have their engines running—in idle); (3) making a passive assessment of TTG (time-to-go) of an inbound ATGM that is heading toward another friendly vehicle by using PBO angle tracking (i.e., using optimized curve-fitting algorithms to process the angle rate and acceleration derived from the angle measurements); (4) cueing the APS (active protection system—radar and self-contained CM firing mechanism systems) radar for purposes of performing/supporting CM effectiveness; (5) supporting threat avoidance (TA) by using the acoustic sensor data that detects NLOS (non-line-of-sight) threats (helicopters and tracked vehicles) that are blocked by terrain (mountains/trees)—and allows the CDA to recommend "soft responses" such as remain still, get close to a hill or tree line for camouflage), posture the main battle gun for an offensive surprise attack due to the precursory information regarding the threat type/ID, angle rate (heading), and inferred onboard threat weapons; (6) using real-time offboard reports regarding threat type/ID and location within the Dempster-Shafer algorithm to correlate subsequent threat reports to the offboard reports and to slant (bias) the threat typing/ID aggregation base on these reports, and more importantly, to "de-weight" the correlation with time as the offboard data becomes stale; (7) using 2-color missile warning data for purposes of threat typing and clutter discrimination (i.e., uses spectral ratio information in a novel manner); (8) minimizing fratricide through the managing of sensor and CM "exclusion zones" whereby reports from sensors in certain sectors around the vehicle are ignored and/or if entities in the battlefield are detected, CM are not applied against them, (9) designing in a modular manner to allow the addition/removal of sensors and countermeasures.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

TABLE 1

CDA Function Descriptions

| Function | Task Description |
|---|---|
| Fusion | Initialize tracks using onboard, offboard and pre-battle data<br>Determine which multispectral sensor data correspond to the same threat by use of kinematic, threat class/ID information at the individual sensor level and the relative time of the received signature information |

TABLE 1-continued

CDA Function Descriptions

| Function | Task Description |
|---|---|
| Threat Typing | Combine threat type confidence values from each sensor using Dempster-Shafer algorithm<br>De-weight the threat type confidence for offboard reports that become invalid as time elapses<br>Use pre-battle information regarding likely threat mix |
| Threat Prioritization | Utilize threat type confidence<br>Assess intent using threat line-of-sight (LOS) information<br>Assess time-to-intercept using IRW signature data and using the vehicle LRF if available<br>Apply the lethality equation or table that uses threat type information and anticipate side of vehicle that will be impacted<br>Factor in Response Effectiveness |
| Resource & Response Management | Control onboard sensors<br>Provide crew threat track data via the solder-machine interface (SMI)<br>Deploy/control CMs when necessary<br>Update crew of CM inventory<br>Take into account crew's preferred CM list, Cm exclusive zones, and other CMs that may be used at the same time |
| Response Effectiveness | Use elapsed time to drop certain tracks |

What is claimed is:

1. A decision aid system for use in the defense of combat ground vehicles comprising:

a means for track fusion comprising a means for temporal association, a means for spatial association, and a means for type association, wherein said means for track fusion initializes tracks using onboard, offboard and pre-battle data, a means for threat typing connected to said means for track fusion, wherein said means for threat typing combines threat type confidence values from said data using a Dempster-Shafer algorithm to determine a threat type, a means for threat prioritization connected to said means for threat typing, wherein said means for threat prioritization utilizes threat type confidence to assign priorities to threats, a means for countermeasures (CM) response management connected to said means for threat prioritization, wherein said means for countermeasures management deploys and controls CMs when necessary, and a means for CM effectiveness assessment connected to said means for threat typing, said means for threat prioritization, and said means for CM response management, wherein said means for CM effectiveness assessment uses elapsed time to drop one or more tracks.

2. The system of claim 1 wherein the system includes an a priori database connected to said means for track fusion, said means for threat typing, said means for threat prioritization, and said means for CM response management.

3. The system of claim 2 wherein the system includes a visual display for crew interface connected to said means for track fusion, means for CM response management and the database.

4. The system of claim 1 wherein the system includes a sensor suite connected to said means for track fusion.

5. The system of claim 4 wherein the sensor suite includes an infrared warning means.

6. The system of claim 4 wherein the sensor suite includes a laser warning means.

7. The system of claim 4 wherein the sensor suite includes a radar warning means.

8. The system of claim 4 wherein the sensor suite includes an acoustic warning means.

9. The system of claim 4 wherein the system includes a countermeasures suite connected to said means for CM response management and CM effectiveness assessment.

10. The system of claim 9 wherein the countermeasures suite includes an anti-tank guided missile (ATGM) jamming means.

11. The system of claim 9 wherein the countermeasures suite includes a laser decoy means.

12. The system of claim 9 wherein the countermeasures suite includes a fire control jamming means.

13. The system of claim 9 wherein the countermeasures suite includes an AP launcher.

14. The system of claim 9 wherein the countermeasures suite includes a smoke generator.

* * * * *